United States Patent [19]

Sterling et al.

[11] 4,033,832

[45] July 5, 1977

[54] METHOD FOR SELECTIVE PLATING

[75] Inventors: Henley F. Sterling, Great Dunmow; Miles P. Drake, Harlow, both of England

[73] Assignee: International Standard Electric Corporation, New York, N.Y.

[22] Filed: June 14, 1976

[21] Appl. No.: 695,736

[30] Foreign Application Priority Data

June 16, 1975 United Kingdom ..... 25584/75

[52] U.S. Cl. ..... 204/15; 204/224 R; 204/275

[51] Int. Cl.[2] ..... C25D 5/02; C25D 5/08; C25D 17/28

[58] Field of Search ..... 204/15, 224 R, 129.6, 204/129.65, 275

[56] References Cited

UNITED STATES PATENTS 3,254,004 5/1966 Jackson et al. ..... 204/15

3,388,047 6/1968 Higgins ..... 204/15

3,657,097 4/1972 Baldock et al. ..... 204/224 R

*Primary Examiner*—T. M. Tufariello

*Attorney, Agent, or Firm*—William T. O'Neil

[57] ABSTRACT

An electro-plating method and apparatus therefor in which a discrete area of plating, such as a stripe about an elongated workpiece can be deposited without the use of separate masking. A plating solution having a depth equal to the length of the stripe desired is floated over a denser, inert, immiscible liquid (such as a liquid fluorocarbon). Workpieces are attached to a carrier which is electrically energized as cathodes and which are positioned vertically such that the area to receive the plated stripe is within the layer of plating solution, the workpieces projecting above the plating solution layer and below into the inert liquid as necessary. Pump weir and sump arrangements provide for maintenance of the plating solution and inert liquid levels and an anode is separately provided.

4 Claims, 3 Drawing Figures

METHOD FOR SELECTIVE PLATING

BACKGROUND OF THE INVENTION

1. Field of the Invention

This invention relates generally to electro-plating and more specifically, to selective plating of discrete areas of workpieces with noble metal.

2. Description of the Prior Art

In certain manufacturing, such as in connection with contacts for electrical connectors, precious metals are used to insure the contact characteristics. Moreover, the use of precious metals demands conservative processing for obvious economic reasons.

It is well known to control the depth of immersion of a workpiece into a plating bath in order to plate only that part which is submerged. However, if it is required to limit the plating on a part of the workpiece as a band spaced from the immersed lower extremity, it is then necessary to mask this lower extremity according to known techniques. Solid masking material or some form of aperture defining assembly may be used, but such measures must be applied prior to immersion of the workpiece in the bath, and subsequently removed after the plating operation has been carried out. The additional labor, care and quality control expense is an obvious disadvantage. The manner in which the unique method and means of the present invention solve this problem will be evident as this description proceeds.

SUMMARY OF THE INVENTION

It was the general object of the invention to provide for automatic masking of a workpiece during the actual plating operation.

According to the invention there is provided a method of selectively plating a workpiece wherein during plating, said workpiece extending through the interface between a plating solution and an underlying, inert, immiscible fluid medium to effectively mask the portion of the workpiece therein against deposition of the plating material.

According to the invention selective plating apparatus is provided comprising a bath containing a plating solution interfacing with an underlying inert fluid medium, and means for inserting a workpiece to be plated into said bath such that said workpiece extends through the interface, the inert fluid medium being effective to mask the portion of the workpiece extending therein against plating by the plating solution. The workpieces are energized as cathodes from a direct current source, and a separate anode structure extends laterally along the plating bath, through which a conveyor arrangement advances the workpieces.

DESCRIPTION OF THE PREFERRED EMBODIMENTS

Figures 1, 2, 3:
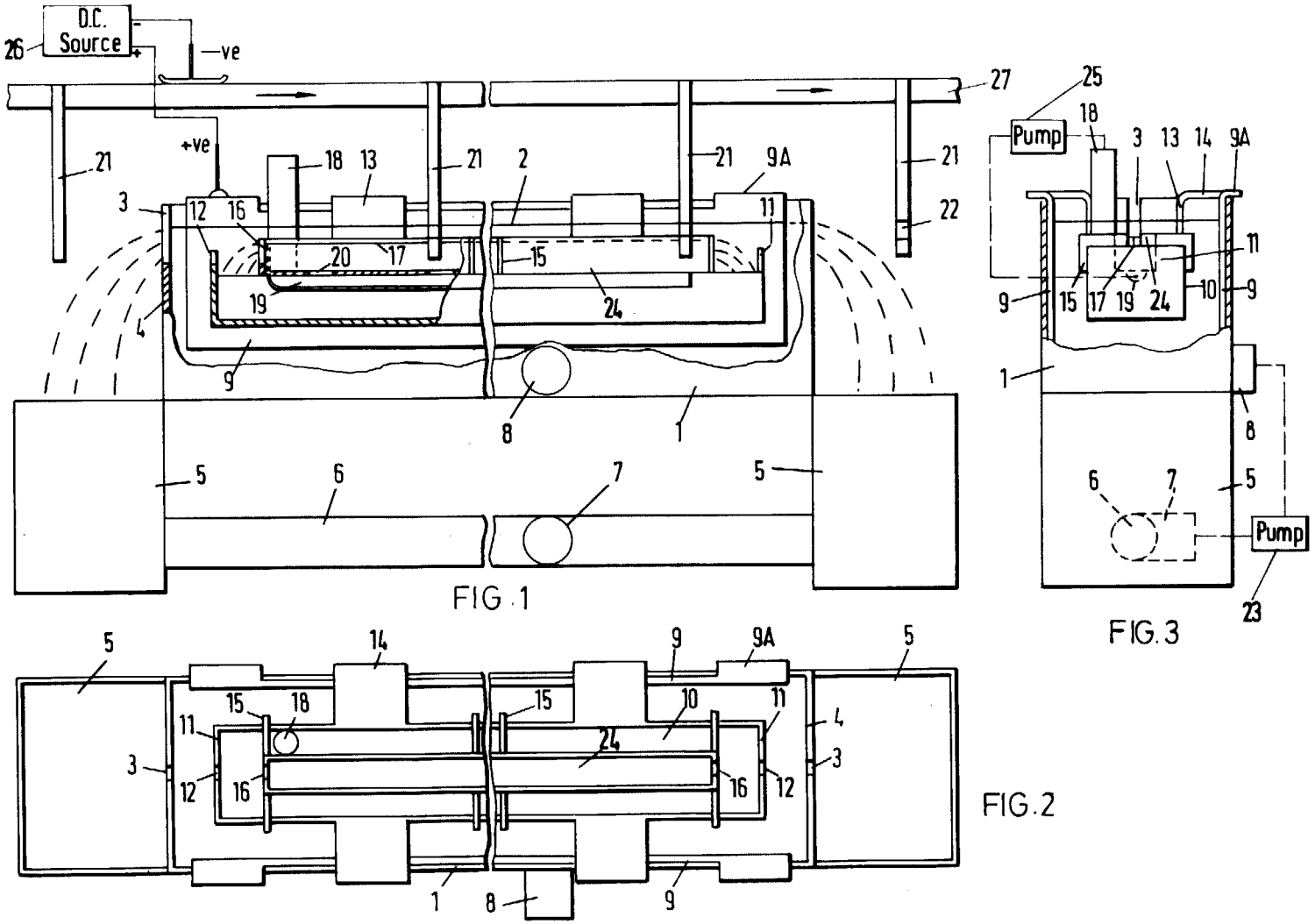
FIGS. 1, 2, and 3 are side, plan and end view respectively, with cut-away sections where necessary, of apparatus for selectively electro-plating according to the invention.

Referring now to the figures of the drawings, an electrolytic plating bath 1 is shown containing a plating solution (of gold for example) to a level indicated by line 2. This level is maintained substantially constant by weirs, formed by axially aligned slots 3 in the respective end walls 4 of the bath, overflowing into reservoirs 5 interconnected by a pipe 6. The head of the solution is maintained at its indicated level by a pump 23 interconnecting reservoir outlet pipe 7 and bath inlet pipe 8.

Along each side of the bath is a plate-like anode 9 which is supported in the plating solution by bent over portions, typically 9A, bearing on the top edge of the bath.

Totally submerged in the plating solution is a second weir system. Structurally, this comprises an open container or sump 10 having upwardly extending end plates 11 each provided with a slot 12 aligned with the slots 3. The sump 10 is supported within the bath typically by upwardly extending members 13 bent outwardly as at 14 at their upper extremities to bear on the top edge of the bath.

Supported in turn by the upper side edges of the sump 10 is a trough 24, from the sides of which extend support members 15 bearing on the side walls of the sump 10. The end walls of the trough have slots 16 aligned with the slots 3 and 12.

The sump 10 and the trough 24 contain a chemically inert liquid which is electrically insulating, more dense than, and immiscible with, the plating solution. A suitable composition for this inert liquid is one of the liquid flurocarbons, such as "Arklone P" (a trade name well known in this art), and another such liquid is "Fluorinert" a product of Minnesota Mining and Manufacturing Co. (3M). The inert liquid level in the trough 24 is indicated by the line 17, this level being maintained substantially constant by virtue of the weirs, formed by the slots 16, which permit the overflowing of the inert liquid into the sump 10 for subsequent return to the trough 24, to maintain this level. A second pump 25 interconnects the sump 10 to an input pipe 18 extending above the bath and replenishing the trough 24 through a pipe 19 which is sealed to the bottom of the trough and is connected thereto by a series of apertures 20.

Workpieces 21 (which may, for example, be blades for an electrical connector) to be selectively electroplated with a gold contact stripe are connected as cathodes by any suitable arrangement, for example from dc source 26 to a conveyor track 27, from which the workpieces are transported through the length of the bath via the aligned entry slots 3, 12, 16, and exit slots 16, 12, and 3 so that each blade is suspended vertically and its lower end is immersed in the electrolyte such that the plating solution level 2 defines the line of the required stripe at its top end (as seen in FIG. 1).

During its initial passage through the plating bath, i.e., between the entry slots 3 and 16, a very thin flash coat of gold will be formed over the whole of the immersed portion of each blade 21 for purposes of appearance and whose relative thickness with respect to the gold band contact area yet to be deposited may be controlled in accordance with known plating technology criteria.

Thereafter, during the passage of each workpiece 21 through the trough 24, which extends for almost the whole length of the bath, typically measured in tens of feet, the lower end of each blade extends into the inert fluid. This fluid effectively masks the portion of each blade inserted therein from being plated. Over the length of the trough, the interface between the plating solution and the inert fluid, defines level 17. The vertical separation between the two levels 2 and 17 determines the limits (length) of the gold contact stripe. The dwell time, and other bath parameters, are of course chosen so that the required thickness of gold of required quality is deposited by the time the blade has emerged from the bath with its gold contact stripe 22 plated thereon.

The upstanding end plates 11 of the sump 10 provide a measure of inert fluid "splash" containment, but bearing in mind that the inert fluid weir system is operating totally submerged in the plating solution, additional or alternative measures may be used to reduce spillovers. In certain circumstances to optimize the practical performance of such a system it may be advantageous to modify the rheological properties of the liquids used.

For the inert liquid, for example, the addition of surface activated, fumed, hydrophobic, sub-micron size particles of silica will impart an increased viscosity without impairing its masking properties. Suitable additives for the plating solution may include polyelectrolytes, functioning as thickening agents.

In the equipment described above, there were two plate anodes 9, one along each side. This will result in deposition occurring on both sides of the immersed workpiece over the required stripe area. Where preferential deposition on one side of the workpiece is required, a single anode, on the side facing that required to be plated may be used. Additional forms of electric current shaping may be used on the side not required to be plated if necessary in electrolytes with modified throwing power.

Still further, the workpieces 21 can be rotated about a vertical axis as they proceed along conveyor 27, if considered necessary for uniform plating.

It will be understood that the above described equipment may be utilized for other forms of plating, such as electrophoresis, or non aqueous plating, e.g., Al from aromatic solutions, and that it is possible to implement the basic method utilizing a static system wherein there is a plating bath containing the plating solution statically floating on the denser, immiscible masking fluid, with one or more workpieces being immersed to a suitable depth to extend through the interface and maintained in this position for the required plating to be carried out.

Another aspect or variation of this invention involves the use of multilayer systems of mutually immiscible liquids. For example, in the two phase system described in detail above (plating solution and denser masking fluid), where the upper surface of the plating solution interfaces with air, an alternative gas (or liquid less dense than the plating solution) may be provided to give a three-phase system, the upper fluid medium serving to protect an air sensitive solution and/or to modify the workpiece/plating solution meniscus. There also could be a four layer system consisting of, in order of decreasing density (bottom up), mercury, liquid fluorocarbon, an aqueous phase (plating solution) and a suitable aromatic hydrocarbon e.g., xylene. The mercury or other liquid metal may be used as a cathode contact or cathode support by flotation. The aromatic phase may be used to protect an air sensitive solution.

Further alternative forms of fluid masking may be achieved by the use of a fluidised bed of particles, e.g., of fine alumina, or beds of fine brush like fibres, e.g., of fine spun glass, both of which provides essentially the fluid medium effective to mask the portion of a workpiece therein against plating by the plating solution.

It is to be understood that the foregoing detailed description of specific examples of this invention and the outlining of variation and modifications possible in accordance with the invention, are presented by way of example only and are not to be considered as limiting the scope of the invention.

What is claimed is:

1. A process for selectively electro-plating a plurality of workpieces comprising the steps of:
   - providing a tank having slots in the opposite end walls thereof opening to the tops of said walls;
   - floating in said tank an electrolytic plating solution layer over a denser, underlying, inert fluid which is immiscible with said plating solution;
   - maintaining the interface of said plating solution and said underlying fluid in said tank at a predetermined level above the bottoms of said slots;
   - conveying said workpieces through said tank via said slots at such a level that said workpieces are immersed in said plating solution, and extend through said interface to a predetermined depth into said underlying fluid, said inert solution operating to mask that portion of the workpieces extending therein to produce a plating stripe on said workpieces having a dimension equal to the depth of said plating solution layer; and
   - electrically energizing said plating solution, with said workpieces being cathode poled, while conveying said workpieces through said tank.

2. A method as claimed in claim 1 wherein said underlying fluid medium comprises a fluidised bed of particles.

3. A process as defined in claim 1 wherein said underlying fluid medium includes an additive in the form of a bed of fine, brush like fibres.

4. A process as defined in claim 1 wherein said underlying inert fluid is a fluorocarbon.

* * * * *